US006418572B1

(12) United States Patent
Epple et al.

(10) Patent No.: US 6,418,572 B1
(45) Date of Patent: Jul. 16, 2002

(54) LEADING EDGE BAR FOR AN AUTOMATIC POOL COVER ASSEMBLY IN A SWIMMING POOL

(75) Inventors: Thomas A. Epple, Fort Wayne; Neiel J. Kuhn, New Haven, both of IN (US)

(73) Assignee: Fort Wayne Pools, Inc., Fort Wayne, IN (US)

( * ) Notice: Subject to any disclaimer, the term of this patent is extended or adjusted under 35 U.S.C. 154(b) by 0 days.

(21) Appl. No.: 09/702,514

(22) Filed: Oct. 31, 2000

(51) Int. Cl.[7] ..... E04H 4/10

(52) U.S. Cl. ..... 4/502

(58) Field of Search ..... 4/498, 502

(56) References Cited

U.S. PATENT DOCUMENTS 3,613,126 A * 10/1971 Granderath ..... 4/502

* cited by examiner

*Primary Examiner*—Robert M. Fetsuga
(74) *Attorney, Agent, or Firm*—Taylor & Aust, P.C.

(57) ABSTRACT

A swimming pool includes a first end wall, a second end wall and a pair of side walls. A cover box is positioned adjacent to the first end wall. A coping is positioned at the top of the side walls and the second end wall. The coping includes a cover track slot. A leading edge bar is associated with the cover track slot and is movable between positions adjacent the first end wall and the second end wall. The leading edge bar includes a nose which fits into the cover track slot of the second end wall when the leading edge bar is adjacent to the second end wall.

11 Claims, 3 Drawing Sheets

LEADING EDGE BAR FOR AN AUTOMATIC POOL COVER ASSEMBLY IN A SWIMMING POOL

BACKGROUND OF THE INVENTION

1. Field of the Invention

The present invention relates to swimming pools, and, more particularly, to an automatic pool cover assembly for use in a swimming pool.

2. Description of the Related Art

A swimming pool generally includes a plurality of upright perimeter walls which surround a pool adjacent to the deck area of the pool. The walls may be construed from metal, plastic or concrete. In the case of plastic or metal walls, it is common to hang a vinyl liner from a coping which surrounds the perimeter of the pool at the top of the perimeter walls. It is also common to cover a swimming pool to prevent dirt, debris, etc. from entering the pool. The cover may be manually extended and retracted over the pool, or may be automatically extended and retracted over the pool.

In the case of an automatic pool cover, a track is typically mounted at the top of opposite side walls of the pool. The track may either be fastened directly to the deck above the side walls, or may be incorporated into the coping at the top of the side walls. A pool cover box is positioned at an end of the pool, typically opposite from the walk-in steps at the deep end of the pool. The automatic cover is wound around a reel contained within the cover box. The cover has a rope which is sewn into the opposite side edges, thereby forming a bead along the opposite side edges. Each bead is retained with a corresponding track at the top of the generally parallel side walls. An electric motor coupled with the reel and the ropes selectively moves the cover to a closed or opened position.

To maintain the cover at a position above the pool as the cover is being moved from the opened to the closed position, or vice versa, a leading edge bar is typically attached to the leading edge of the cover. The leading edge bar extends the width of the pool and is attached to the leading edge of the cover. Typically, the leading edge of the cover is simply sewn to form a loop through which the generally cylindrical leading edge bar extends.

Although sufficient to move the cover from the opened to the closed position, or vice versa, it is possible to permanently deflect the leading edge bar in a downward direction when the leading edge bar is at the opened or closed positions. Moreover, the leading edge bar is easily discernable from the other components of the pool when at either the opened or closed positions.

What is needed in the art is a leading edge bar which is not deflectible to an appreciable extent in a downward direction at either the opened or closed positions, and which is more aesthetically appealing.

SUMMARY OF THE INVENTION

The present invention provides a swimming pool including a leading edge bar which locks in place and is prevented from downward deflection when at the fully opened or fully closed positions.

The invention comprises, in one form thereof, a swimming pool including a first end wall, a second end wall and a pair of side walls. A cover box is positioned adjacent to the first end wall. A coping is positioned at the top of the side walls and the second end wall. The coping includes a cover track slot. A leading edge bar is associated with the cover track slot and is movable between positions adjacent a first end wall and a second end wall. The leading edge bar includes a nose which fits into the cover track slot of the second end wall when the leading edge bar is adjacent to the second end wall.

The invention comprises, in another form thereof, a swimming pool including a first end wall, a second end wall and a pair of side walls. A cover box is positioned adjacent to the first end wall. A coping is associated with the first end wall, the second end wall and the pair of side walls. A leading edge bar is movable between positions adjacent to the first end wall and the second end wall. The leading edge bar includes a rearwardly facing wall having a shape which is complimentary to and mates with the coping above the first end wall when the leading edge bar is adjacent to the first end wall.

An advantage of the present invention is that deflection of the leading edge bar is prevented when the leading edge bar is at the fully opened or fully closed position.

Another advantage is that the leading edge bar is provided with a rearwardly extending flange which acts as a guide surface as the leading edge bar approaches the coping when moved to the fully opened position.

Yet another advantage is that the leading edge bar may be provided with a bumper which absorbs shock and seals the leading edge bar relative to the coping when at the fully closed position.

A still further advantage is that the leading edge bar may be provided with a shape which is generally the same as the coping.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 4:
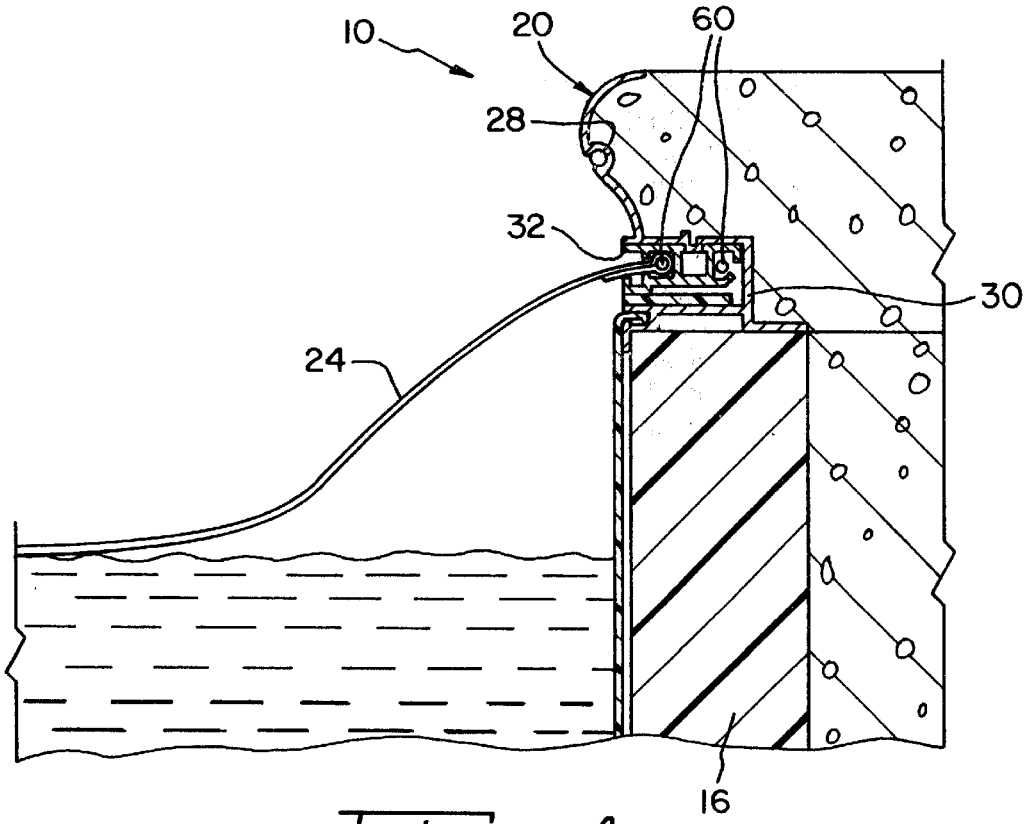
FIG. 4 is a fragmentary, side view taken along line 4—4 of FIG. 3.

Referring now to the drawings, there is shown a portion of an embodiment of a swimming pool 10 of the present invention. Swimming pool 10 generally includes a first end wall 12, a second end wall 14, a pair of side walls 16, a cover box 18, a coping 20, a leading edge bar 22 and a cover 24. First end wall 12, second end wall 14 and side walls 16 surround swimming pool 10. Coping 20 is positioned at the top of side walls 16 and second end wall 14. Coping 20 includes a facia 26, fiber optic light slot 28 and cover track slot 30. Facia 26 may have any suitable curvature, and in the embodiment has a compound curvature. Fiber optic slot 28 is positioned within facia 26 above cover track slot 30. Fiber optic slot 28 receives a fiber optic light tube (not shown) therein which surrounds swimming pool 10. Cover track slot 30 receives a cover track 32 therein along each side wall 16 (FIG. 4). Cover track slot 30 remains empty (i.e., does not contain cover track 32 therein) on second end wall 14.

Cover box 18 carries a reel 34 therein, which in turn carries an automatic cover 24 which is used to cover swimming pool 10, as will be described hereinafter. Cover box 18 includes a lid 38 positioned over reel 34. Lid 38 is attached with and carries coping 20 positioned over first end wall 12. Coping 20 positioned over first end wall 12 is disposed in generally vertical alignment with coping 20 positioned over each side wall 16 such that fiber optic slot 28 is aligned around the entire periphery of swimming pool 10.

Leading edge bar 22 is slidably carried by the pair of cover tracks 32 associated with each side wall 16. Leading edge bar 22 is movable between a position adjacent first end wall 12 and second end wall 14. Leading edge bar 22 is in the form of a "low profile" leading edge bar, and generally includes a nose 40, front slot 42, rear slot 44, bumper 46 and rearwardly extending flange 48.

Rear slot 44 has a generally circular cross-section, and receives a leading edge 50 of cover 24 therein. More particularly, leading edge 50 of cover 24 has a cord or rope (not numbered) which is sewn therein. The leading edge 50 of cover 24 is then slid in a longitudinal direction within rear slot 44 of leading edge bar 22. Rearwardly extending flange 48 includes a downwardly turned end (not numbered) which provides a guide surface for coping 20 positioned above first end wall 12 as leading edge bar 22 approaches first end wall 12. Thus, flange 48 is positioned under coping 20 when leading edge bar 22 is adjacent first end wall 12 as cover 24 is moved to the fully retracted position.

Front slot 42 carries bumper 46 therein. Bumper 46 is preferably formed from an elastomeric material, such as rubber, and abuts facia 26 of coping 20 when leading edge bar 22 and cover 24 are moved to the fully closed positioned over swimming pool 10. Bumper 46 may have any suitable configuration, and in the embodiment shown has a generally U-shaped configuration with a bead which fits into front slot 42. Bumper 46 abuts facia 26 of coping 20 over second end wall 14 when leading edge bar 22 is adjacent second end wall 14. Additionally, nose 40 fits within cover track slot 30 of coping 20 over second end wall 14 when leading edge bar 22 is adjacent second end wall 14.

End cap coping 52 is attached to the top of first end wall 12. End cap coping 52 includes a liner bead slot 54 and fastener slot 58. Liner bead slot 54 receives the bead of a vinyl liner which is hung adjacent the interior wall of first end wall 12. Fastener slot 58 allows fasteners such as self-tapping screws to be used to fasten end cap coping 52 to the top of first end wall 12. The heads of each fastener (not shown) are received within fastener slot 58 such that cover 24 does not contact the fastener heads.

During use, leading edge bar 22 and cover 24 are moved to a retracted position over swimming pool 10 by energizing an electric motor (not shown) which is mechanically coupled with reel 34. Flange 48 acts as a guide surface below coping 20 as leading edge bar 22 moves adjacent to coping 20 positioned over first end wall 12. When in the fully retracted position, leading edge bar 46 is positioned vertically adjacent end cap coping 52 such that vertical deflection of leading edge bar 22 is prevented. To move leading edge bar 22 and cover 24 to the extended or closed position over swimming pool 10, the electric motor is again energized to engage a reel (not shown) to which rope 60 carried by each side edge of cover 24 is attached. Rope 60 pulls cover 24 to the closed position, and the leading edge 50 of cover 24 slides leading edge bar 22 along each cover track 32. When in the closed position, nose 40 fits within cover track slot 30 over second end wall 14, and bumper 46 abuts facia 26 of coping 20 over second end wall 14.

Swimming pool 10 of the present invention is configured such that leading edge bar 22 is vertically supported when at either the closed or opened position. Vertical deflection of leading edge bar 22 is thus inhibited when at the closed or opened positions.

Figure 1:
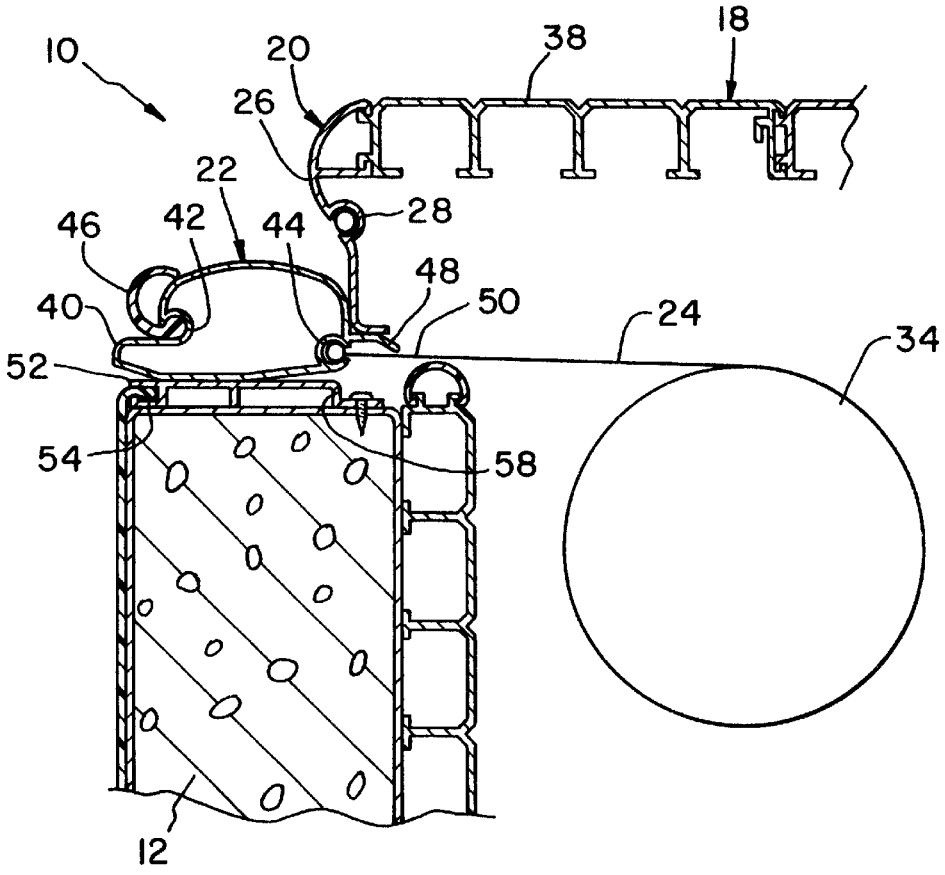
FIG. 1 is a fragmentary, side view of a swimming pool including an embodiment of a leading edge bar of the present invention when the leading edge bar is at the opened position.
Figure 2:
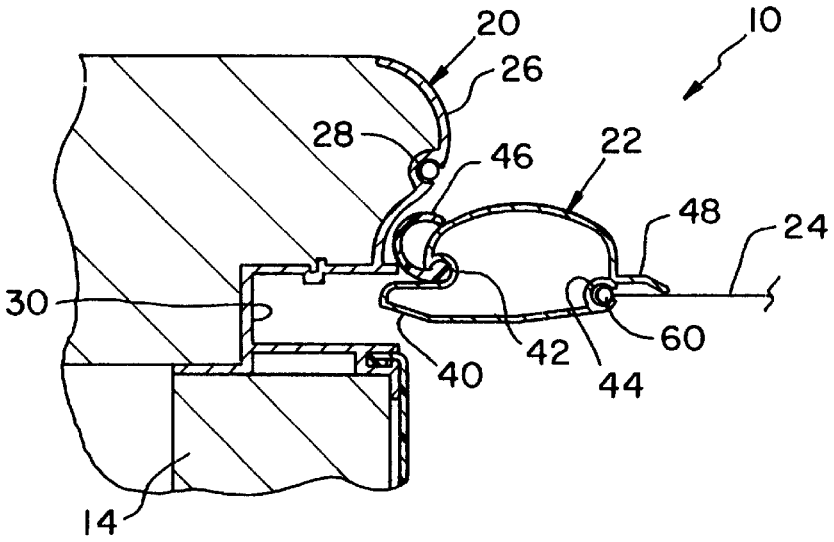
FIG. 2 is a fragmentary, side view of the swimming pool of FIG. 1 when the leading edge bar is at the closed position.
Figure 3:
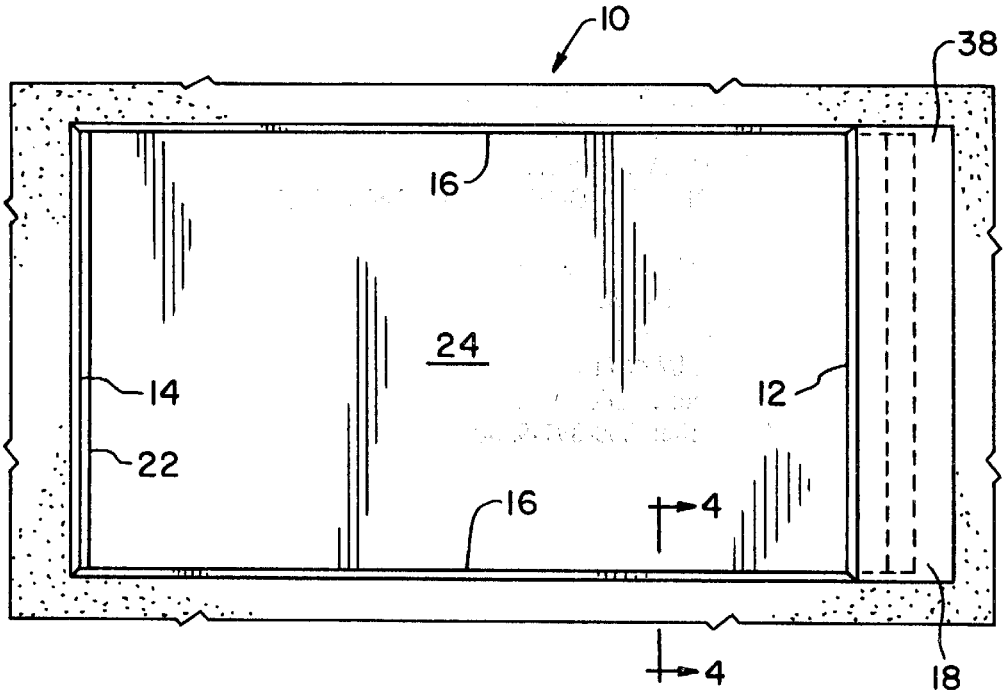
FIG. 3 is a top view of the swimming pool of FIGS. 1 and 2 when the leading edge bar is at the closed position.
Figure 5:
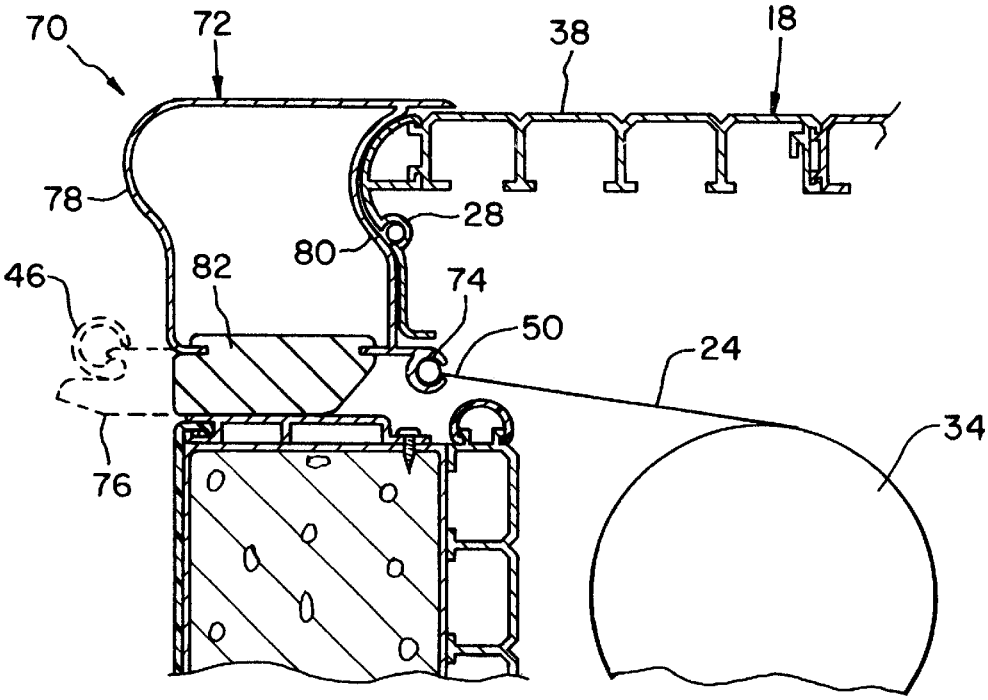
FIG. 5 illustrates another embodiment of a swimming pool including a leading edge bar of the present invention, when the leading edge bar is at the fully opened position.
Figure 6:
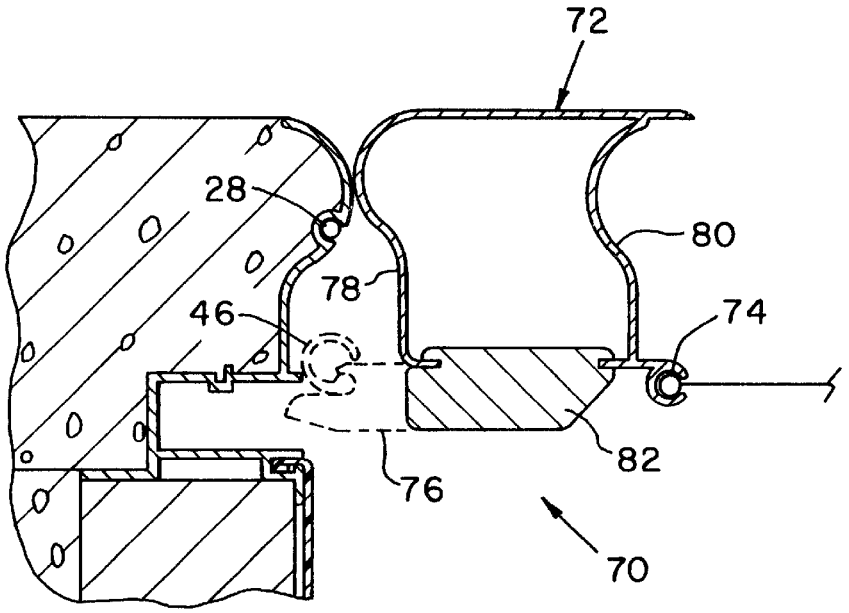
FIG. 6 illustrates another embodiment of a swimming pool including a leading edge bar of the present invention, when the leading edge bar is at the fully closed position.

FIGS. 5 and 6 illustrate an embodiment of a swimming pool 70 including another embodiment of a leading edge bar 72 of the present invention. Leading edge bar 72 includes a rear slot 74 for retaining a leading edge 50 of cover 24, similar to rear slot 44 of leading edge bar 22 shown in FIGS. 1–4. Leading edge bar 72 may also include an optional nose 76 for engaging cover track slot 30 of an opposite second end wall 14, similar to nose 40 shown in FIGS. 1–4.

Leading edge bar 72 differs from leading edge bar 22 in that it includes a front wall 78 and a rear wall 80 which each approximate the shape of coping 20 surrounding swimming pool 70. Thus, when leading edge bar 72 is positioned adjacent to coping 20 over first end wall 12, front wall 78 has the same general shape as coping 20 and thus in essence replaces the appearance of coping 20. Moveover, rear wall 80 has a shape which mates with coping 20. The mating engagement between rear wall 80 and coping 20 prevents downward deflection of leading edge bar 72. Additionally, downward deflection is limited by block 82 of leading edge bar 72 being positioned immediately above end cap coping 52.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool, comprising:

a first end wall, a second end wall and a pair of side walls;

a cover box adjacent said first end wall;

a coping at a top of said side walls and said second end wall, said coping including a cover track slot; and a leading edge bar associated with said cover track slot and movable between positions adjacent said first end wall and said second end wall, said leading edge bar including a nose which fits into and extends continuously across said cover track slot of said second end wall when said leading edge bar is adjacent said second end wall, thereby being substantially sealed with said second end wall.

2. The swimming pool of claim 1, said coping also being positioned above said first end wall, said leading edge bar including a rearwardly facing wall having a shape which is complimentary to and mates with said coping above said first end wall when said leading edge bar is adjacent said first end wall.

3. The swimming pool of claim 1, including an end cap coping at a top of said first end wall, said leading edge bar being at least partially supported by said end cap coping when said leading edge bar is adjacent said first end wall.

4. A swimming pool, comprising:

a first end wall, a second end wall and a pair of side walls;

a cover box adjacent said first end wall;

a coping at a top of said side walls and said second end wall, said coping including a cover track slot; and a leading edge bar associated with said cover track slot and movable between positions adjacent said first end wall and said second end wall, said leading edge bar including a nose which fits into said cover track slot of said second end wall when said leading edge bar is adjacent said second end wall, said leading edge bar further including a rear slot, and a cover having a leading edge carried by said rear slot.

5. A swimming pool, comprising:

a first end wall, a second end wall and a pair of side walls;

a cover box adjacent said first end wall;

a coping at a top of said side walls and said second end wall, said coping including a cover track slot and a pair of cover tracks, each said cover track positioned within said cover track slot on a corresponding said side wall, said cover having opposite side edges carried by a corresponding said cover track; and a leading edge bar associated with said cover track slot and movable between positions adjacent said first end wall and said second end wall, said leading edge bar including a nose which fits into said cover track slot of said second end wall when said leading edge bar is adjacent said second end wall.

6. A swimming pool, comprising:

a first end wall, a second end wall and a pair of side walls;

a cover box adjacent said first end wall;

a coping at a top of said side walls and said second end wall, said coping including a cover track slot; and a leading edge bar associated with said cover track slot and movable between positions adjacent said first end wall and said second end wall, said leading edge bar including a nose which fits into said cover track slot of said second end wall when said leading edge bar is adjacent said second end wall, said leading edge bar further including a front slot, and a bumper carried by said front slot, said bumper abutting said coping of said second end wall when said leading edge bar is adjacent said second end wall.

7. The swimming pool of claim 6, said coping including a facia positioned above said cover track slot, said bumper abutting said facia when said leading edge bar is adjacent said second end wall.

8. The swimming pool of claim 6, said bumper comprising a rubber bumper.

9. A swimming pool, comprising:

a first end wall, a second end wall and a pair of side walls;

a cover box adjacent said first end wall;

a coping at a top of said side walls and said second end wall, said coping including a cover track slot; and a leading edge bar associated with said cover track slot and movable between positions adjacent said first end wall and said second end wall, said leading edge bar including a nose which fits into said cover track slot of said second end wall when said leading edge bar is adjacent said second end wall, said coping being positioned above said first end wall, said leading edge bar including a rearwardly extending flange positioned under said coping when said leading edge bar is adjacent said first end wall.

10. The swimming pool of claim 9, said flange including a downwardly turned end providing a guide surface for said coping above said first end wall as said leading edge bar approaches said first end wall.

11. The swimming pool of claim 9, said cover box including a lid, said coping above said first end wall being carried by said lid.

* * * * *